US010337091B2

(12) United States Patent
Lee et al.

(10) Patent No.: US 10,337,091 B2
(45) Date of Patent: Jul. 2, 2019

(54) HIGH HEAT RESISTANT STEEL WITH LOW NICKEL

(71) Applicants: Hyundai Motor Company, Seoul (KR); Kia Motors Corporation, Seoul (KR)

(72) Inventors: Jung-Suk Lee, Yongin-si (KR); Yeun-Chang Choi, Whasung-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 48 days.

(21) Appl. No.: 15/367,055

(22) Filed: Dec. 1, 2016

(65) Prior Publication Data

US 2018/0073112 A1 Mar. 15, 2018

(30) Foreign Application Priority Data

Sep. 9, 2016 (KR) ..... 10-2016-0116167

(51) Int. Cl.

| | |
|---|---|
| ***C22C 38/48*** | (2006.01) |
| ***C22C 38/00*** | (2006.01) |
| ***C22C 38/02*** | (2006.01) |
| ***C22C 38/04*** | (2006.01) |
| ***F01D 25/24*** | (2006.01) |
| *F02B 37/00* | (2006.01) |

(52) U.S. Cl.

CPC ..... *C22C 38/48* (2013.01); *C22C 38/001* (2013.01); *C22C 38/02* (2013.01); *C22C 38/04* (2013.01); *F01D 25/24* (2013.01); *F02B 37/00* (2013.01); *F05D 2220/40* (2013.01); *F05D 2300/171* (2013.01); *F05D 2300/5023* (2013.01)

(58) Field of Classification Search

CPC ..... C22C 38/48; C22C 38/001; C22C 38/02; C22C 38/04; C22C 38/08; C22C 38/18; C22C 38/26; C22C 38/34; C22C 38/40; F01D 25/24; F02B 37/00; F05D 2220/30; F05D 2220/40; F05D 2300/171; F05D 2300/5023

See application file for complete search history.

(56) References Cited

U.S. PATENT DOCUMENTS

| | | | | |
|---|---|---|---|---|
| 3,826,689 | A * | 7/1974 | Sadao et al. | C22C 19/058 148/540 |
| 2006/0266439 | A1 | 11/2006 | Maziasz | |
| 2007/0217941 | A1 | 9/2007 | Hayashi et al. | |
| 2009/0324441 | A1 | 12/2009 | Weiss et al. | |
| 2014/0255245 | A1* | 9/2014 | Schall | C22C 38/02 420/51 |

FOREIGN PATENT DOCUMENTS

| | | |
|---|---|---|
| JP | 6-94583 B2 | 11/1994 |
| JP | 2006-118048 | 5/2006 |
| JP | 5227359 B2 | 7/2013 |

* cited by examiner

*Primary Examiner* — Alexandra M Moore

(74) *Attorney, Agent, or Firm* — Morgan, Lewis & Bockius LLP

(57) ABSTRACT

A high heat resistant steel with low nickel has high tensile strength and high heat resistance at a high temperature, wherein a value of X/Y is 0.44 to 0.47, and wherein the X is a value calculated by Equation 1, [Equation 1 is X=wt % of Cr+wt % of 1.5×Si+wt % of 0.5×Nb], and the Y is a value calculated by Equation 2 [Equation 2 is Y=wt % of Ni+wt % of 0.5×Mn+wt % of 30×C+wt % of 30×N].

2 Claims, No Drawings

HIGH HEAT RESISTANT STEEL WITH LOW NICKEL

CROSS-REFERENCE TO RELATED APPLICATIONS

This application claims under 35 U.S.C. § 119(a) the benefit of Korean Patent Application No. 10-2016-0116167, filed on Sep. 9, 2016, the disclosure of which is incorporated herein by reference in its entirety for all purposes.

BACKGROUND OF THE INVENTION

Field of the Invention

The present invention relates to heat resistant steel for a turbine housing of an automotive turbocharger, and more particularly, to a high heat resistant steel with low nickel content. The high heat resistant steel has high tensile strength and high heat resistance at a high temperature and has low Ni content which provides a cost reduction effect.

Description of the Related Art

For environmental protection, high performance, improvement of fuel efficiency, and reduction of exhaust gas of an automotive engine are desired. Accordingly, recent vehicles have included high-efficiency and high-performance engines installed with a turbocharger.

Herein, the term turbocharger refers to combining a turbine and a supercharger, thus configured by a turbine and a compressor directly connected thereto to rotate a turbine wheel using energy of the exhaust gas and compress air suctioned by the compressor to transmit the compressed air to a cylinder. The main body of the turbocharger is positioned around an exhaust manifold assembly portion as a simple structure in which a turbine wheel installed with a blade and a compressor wheel are connected to one shaft and covered by a housing, respectively.

The turbine housing is a component which occupies nearly a half of the weight and the cost of the turbocharger and through which hot exhaust gas at 800 to 950° C. is passed and discharged from an engine combustor. The turbine housing possess high-temperature tensile strength and durability.

Typically, the general engine exhaust gas temperature is about 800 to 950° C., but in the future, in order to improve performance and output of the turbocharger, the temperature is expected to be increased to a level of 1,000 to 1,050° C. Accordingly, when the exhaust gas temperature is increased, a material having higher heat resistance needs to be applied to the turbine housing of the turbocharger.

In a turbine housing disclosed in the related art, a steel material added with about 10 to 20 wt % of nickel (Ni) was used. In some instances, when the exhaust temperature of a part of the engine was 1,000° C. or more, high heat resistant steel added with about 35 wt % of Ni was used. In other cases, a 35 wt % Ni-based alloy had high-temperature tensile strength of about 180 to 190 MPa at 900° C. In some cases, a 30 to 40 wt % Ni-based alloy showed excellent characteristics compared to a 10 to 20 wt % Ni-based alloy, however large amounts of Ni make Ni-based alloys expensive.

For high durability, the material used in the turbine housing in the related art includes high-temperature antioxidant iron and the like. Such a material is prepared by adding elements such as silicon (Si) and molybdenum (Mo) to nodular graphite cast iron for improvement of properties and oxidation resistance at a high temperature. However, heat resistant case iron is generally used at a temperature range of about 630 to 760° C., and an exhaust gas temperature can range from about 700 to 800°. The above materials in the temperature range have tensile strength of about 60 MPa and a higher heat resistance is needed. Accordingly, case iron fails to provide the desired properties needed for a turbine housing material.

Therefore, the present invention relates to high heat resistant steel applied to a turbine housing. Particularly, provided herein is a high heat resistant steel that has high heat resistance and high tensile strength at a high temperature. This high heat resistant steel contains low Ni content and thus, reduces cost.

SUMMARY OF THE INVENTION

An exemplary embodiment of the present invention provides a high heat resistant steel with low Ni content, in which a value of X/Y is 0.44 to 0.47, wherein the X is a value calculated by Equation 1 (Equation 1 is X=wt % of Cr+wt % of 1.5×Si+wt % of 0.5×Nb) and the Y is a value calculated by Equation 2 (Equation 2 is Y=wt % of Ni+wt % of 0.5×Mn+wt % of 30×C+wt % of 30×N).

In some embodiments, wt % of the C may be from about 0.5 to 0.7 wt %.

In some embodiments, wt % of the Si may be from about 1.3 to 1.7 wt %.

In some embodiments, wt % of the Mn may be from about 0.6 to 1.0 wt %.

In some embodiments, wt % of the Ni may be from about 24.0 to 26.0 wt %.

In some embodiments, wt % of the Cr may be from about 18.0 to 20.0 wt %.

In some embodiments, wt % of the Nb may be from about 1.0 to 2.0 wt %.

In some embodiments, wt % of the N may be from about 0.15 to 0.20 wt %.

In some embodiments, wt % of the C may be from about 0.5 to 0.7 wt %, wt % of the Si may be from about 1.3 to 1.7 wt %, wt % of the Mn may be from about 0.6 to 1.0 wt %, wt % of the Ni may be from about 24.0 to 26.0 wt %, wt % of the Cr may be from about 18.0 to 20.0 wt %, wt % of the Nb may be from about 1.0 to 2.0 wt %, and wt % of the N may be from about 0.15 to 0.20 wt %.

Another exemplary embodiment of the present invention provides an automotive turbine housing manufactured using the high heat resistant steel with low Ni.

The high heat resistant steel with low Ni of the present invention exhibits high tensile strength at a high temperature, has high heat resistance, and provides a cost reduction effect based, in part, on the reduced Ni content.

The high heat resistant steel described herein can reduce the weight of a high-performance and high-output turbocharger while providing high heat resistance at high exhaust gas temperatures. The high heat resistant steel with low Ni of the present invention can be applied to a turbine housing.

DETAILED DESCRIPTION OF THE EMBODIMENTS

Hereinafter, exemplary embodiments of the present invention will be described in detail. Terms or words used in the present specification and claims, which will be described below should not be interpreted as being limited to typical or dictionary meanings, but should be interpreted as having meanings and concepts which comply with the technical spirit of the present invention, based on the principle that an inventor can appropriately define the concept of the term to describe his/her own invention in the best manner. Therefore, the exemplary embodiments and the drawings described in the present specification are only the most preferred exemplary embodiment of the present invention and do not represent all of the technical spirit of the present invention, and thus it is to be understood that various equivalents and modified examples, which may replace the configurations, are possible when filing the present application.

A turbocharger includes the combination of a turbine and a supercharger, and is configured by a turbine and a compressor directly connected thereto to rotate a turbine wheel by energy of the exhaust gas and compress air suctioned by the compressor to transmit the compressed air to a cylinder. The main body of the turbocharger is positioned around an exhaust manifold assembly portion as a simple structure in which a turbine wheel installed with a blade and a compressor wheel are connected to one shaft and covered by a housing, respectively.

The turbine housing is a component which occupies nearly a half of the weight and the cost of the turbocharger. Hot exhaust gas at 800° C. to 950° C. discharges from the engine combustor and passes through the housing. To improve the performance and output of the turbocharger, the temperature of the exhaust gas can be increased to 1,000 to 1,050° C. The material of the turbine housing should also exhibit higher high-temperature tensile strength and higher durability at these temperatures.

Hereinafter, the present invention will be described in detail. The present invention relates to high heat resistant steel applied to the turbine housing. The high heat resistant steel with low Ni has high tensile strength and high heat resistance at high temperatures while also reducing the Ni content for cost reduction.

In order to obtain the technical effect, in the present invention, a ratio of a chromium (Cr) equivalent to a nickel (Ni) equivalent is optimized. The reason is that in a heat resistant alloy to which an alloy element such as Cr and Ni is added, values of a Cr equivalent and a Ni equivalent are indexes representing heat resistance. Accordingly, in the present invention, a Cr equivalent $Cr_{eq}$ is defined as X and a Ni equivalent $Ni_{eq}$ is defined as Y, and the X and Y are values calculated by Equations 1 and 2 below. Further, X/Y means a ratio of a Cr equivalent to a Ni equivalent, that is, an equivalent ratio.

$$X = \text{wt \% of Cr} + \text{wt \% of } 1.5\times\text{Si} + \text{wt \% of } 0.5\times\text{Nb} \quad \text{[Equation 1]}$$

$$Y = \text{wt \% of Ni} + \text{wt \% of } 0.5\times\text{Mn} + \text{wt \% of } 30\times\text{C} + \text{wt \% of } 30\times\text{N} \quad \text{[Equation 2]}$$

Cr has an atomic structure of a body-centered cubic (BCC) structure and Ni has an atomic structure of a face-centered cubic (FCC) structure. The BCC is a structure in which tensile strength at room temperature is excellent, but tensile strength at a high temperature is rapidly deteriorated, and the FCC has slightly lower tensile strength than the BCC at room temperature, but maintains high tensile strength at a high temperature. Accordingly, a structure suitable for a heat-resistive alloy for a high temperature is the FCC structure.

Cr is an alloy that stabilizes the BCC structure and as an alloy element that plays a similar role thereto, molybdenum (Mo), silicon (Si), and niobium (Nb) are included. On the other hand, Ni is an element that stabilizes the FCC structure and as an element that plays a similar role thereto, manganese (Mn), carbon (C), and nitrogen (N) are included.

That is, in order to improve heat resistance, the X needs to be decreased or the Y needs to be increased. As such, the Ni equivalent, that is, the Y value that maintains high tensile strength at a high temperature needs to be increased. In the present invention, the content of the Ni alloy element is reduced to implement the cost reduction. In addition, the value of X/Y is set to about 0.44 to 0.47 (e.g., about 0.44, 0.45, 0.46, or about 0.47) by adjusting the alloy elements that play a similar role to Ni by an equivalent formula and appropriately adjusting a ratio with X which is the Cr equivalent value to prepare an alloy.

More particularly, the alloy design range considering the equivalent ratio in the present invention may be about 0.5 to about 0.7 wt % (e.g., about 0.5, 0.6 or about 0.7 wt %) of carbon (C), about 1.3 to about 1.7 wt % (e.g., about 1.3, 1.4, 1.5, 1.6, or about 1.7 wt %) of silicon (Si), about 0.6 to about 1.0 wt % (e.g., about 0.6, 0.7, 0.8, 0.9, or about 1.0 wt %) of manganese (Mn), about 18 to about 20 wt % (e.g., about 18, 19, or about 20 wt %) of chrome (Cr), about 1.0 to about 2.0 wt % (e.g., about 1.0, 1.1, 1.2, 1.3, 1.4, 1.5, 1.6, 1.7, 1.8, 1.9, or about 2.0 wt %) of niobium (Nb), about 0.15 to about 0.20 wt % (e.g., about 0.15, 0.16, 0.17, 0.18, 0.19 or about 0.2 wt %) of nitrogen (N), about 24 to about 26 wt % (e.g., about 24, 25 or about 26 wt %) of nickel (Ni).

The C may be an element with improved heat resistance and castability and the content of the C may be about 0.5 to about 0.7 wt % (e.g., about 0.5, 0.6 or about 0.7 wt %). When the content of the C is less than 0.5 wt %, a heat resistance improvement effect is slight, whereas when the content of the C is greater than 0.7 wt %, the C is coupled with other alloy elements to form coarse carbide to rather deteriorate the strength.

The Si is an element for improving castability. Accordingly, when the content of the Si may be about 1.3 to about 1.7 wt % (e.g., about 1.3, 1.4, 1.5, 1.6, or about 1.7 wt %). When the content of the Si is less than 1.3 wt %, castability is decreased and thus casting defects such as misrun, short run, and bubbles are easily generated when a casting product is manufactured. The misrun means a casting product in which molten metal is very overcooled during casting, coagulated before being completely injected to a template, and then cannot be used. Further, when the content of the Si is greater than 1.7 wt %, there is a disadvantage that the X value which is the Cr equivalent is increased and thus heat resistance is decreased. Accordingly, when the content of the Si may be about 1.3 to 1.7 wt %, heat resistance is not decreased and castability is enhanced.

The Mn is an austenite stabilizing element which has a high-temperature stable phase and serves to improve heat resistance by increasing the Y value which is the Ni equivalent ratio. Accordingly, the content of the Mn may be about 0.6 to 1.0 wt % (e.g., about 0.6, 0.7, 0.8, 0.9, or about 1.0 wt %). When the content of the Mn is less than 0.6 wt %, an effect of improving heat resistance is slight and when the content of the Mn is greater than 1.0 wt %, there is a disadvantage that castability is deteriorated. As a result, in order to improve heat resistance and prevent deterioration of castability, the content of the Mn may be 0.6 to 1.0 wt % (e.g., about 0.6, 0.7, 0.8, 0.9, or about 1.0 wt %).

The Ni is an austenite stabilizing element which has a high-temperature stable phase and serves to improve heat resistance by increasing the Y value which is the Ni equivalent ratio. As such, it is advantageous to improve heat resistance by increasing the Ni addition amount, but since the Ni is an expensive element, the addition amount may be set to about 24 to 26 wt % (e.g., about 24, 25 or about 26 wt %) which is a minimal addition amount to have heat resistance which is equal to a high heat resistance material in the related art by considering a cost aspect. In other words, when the addition amount is less than 24 wt %, heat resistance is difficult to be fit to the same level as the related art and when the addition amount is greater than 26 wt %, an increase in cost is excessive and thus there is a limitation in industrial availability.

The Cr is an element with improved heat resistance which is coupled with the C to form a high-temperature stable carbide. Accordingly, the content of the Cr may be about 18 to 20 wt % (e.g., about 18, 19, or about 20 wt %). When the content of the Cr is less than 18 wt %, the formation amount of the high-temperature stable carbide is not sufficient, and when the content of the Cr is greater than 20 wt %, rather, there is a disadvantage that the X value as the Cr equivalent is increased, but heat resistance is decreased.

The Nb is an element with improved heat resistance which is coupled with C to form the high-temperature stable carbide and the content of the Nb may be 1.0 to 2.0 wt % (e.g., about 1.0, 1.1, 1.2, 1.3, 1.4, 1.5, 1.6, 1.7, 1.8, 1.9, or about 2.0 wt %). When the content of the Nb is less than 1.0 wt %, the formation amount of the high-temperature stable carbide is not sufficient, and when the content of the Nb is greater than 2.0 wt %, the carbide consumes a large amount of C in a mother material which is an element with improved heat resistance and thus rather, heat resistance may be decreased.

The N is a main core element of the present invention and a main alloy element which improves the Y value as the Ni equivalent ratio. When an appropriate amount is added, significantly excellent heat resistance may be ensured. Accordingly, the content of the N may be about 0.15 to about 0.20 wt % (e.g., about 0.15, 0.16, 0.17, 0.18, 0.19 or about 0.2 wt %). When the content of the N is less than 0.15 wt %, a target equivalent ratio may not be fit, and when the content of the N is greater than 0.20 wt %, higher heat resistance than the target equivalent ratio may be ensured, but during casting, it may be difficult to control gas defects. Accordingly, it is preferred that the content of the N is limited to a range of about 0.15 to about 0.20 wt % (e.g., about 0.15, 0.16, 0.17, 0.18, 0.19 or about 0.2 wt %) which is a level at which casting defects are not generated while the heat resistance can be ensured.

As a result, according to the present invention, the equivalent ratio (X/Y) is set to a range of about 0.44 to about 0.47 (e.g., about 0.44, 0.45, 0.46, or about 0.47) by combining the addition amount of the element and an excellent casting alloy having high heat resistance while having excellent cost competitiveness with low Ni may be manufactured.

When the alloy of the present invention is applied to the automotive turbine housing, heat resistance is increased and thus the thickness of the turbine housing is decreased to reduce a weight.

TABLE 1

| Classification | C | Si | Mn | Ni | Cr | Nb | N | X/Y |
|---|---|---|---|---|---|---|---|---|
| Material in the related art - general material (20% Ni based) | 0.3~0.5 | 1.0~2.5 | 2.0 Max. | 19~22 | 24~27 | — | — | |
| Material in the related art - high heat resistant material (35% Ni based) | 0.3~0.5 | 1.0~2.5 | 1.5 Max. | 36~39 | 17~19 | 1.2~1.8 | — | 0.46 |
| Material in the present invention | 0.5~0.7 | 1.3~1.7 | 0.6~1.0 | 24~26 | 18~20 | 1.0~2.0 | 0.15~0.2 | 0.45 |

Table 1 illustrates alloy element contents of a general material (the Ni content of about 20 wt %) in the related art, a heat resistant material (the Ni content of about 35 wt %) in the related art, and a material (the Ni content of 24 to 26 wt %) in the present invention.

The technology of the present invention reduces the Ni content as compared with the heat resistant material in the related art and thus the cost can be reduced by about 30% and the high-temperature tensile strength is improved by about 30% as compared with a general heat resistant casting material in the related art. Further, when the high heat resistant steel with low Ni of the present invention is applied to the turbine housing, the weight is reduced by about 30%.

TABLE 2

| Classification | C | Si | Mn | Ni | Cr | Nb | N | X/Y | High-temperature tensile strength (900° C.) | Castability |
|---|---|---|---|---|---|---|---|---|---|---|
| Example 1 | 0.51 | 1.32 | 0.61 | 24.2 | 18.2 | 1.01 | 0.15 | 0.47 | 191 MPa | Good |
| Example 2 | 0.69 | 1.69 | 0.98 | 25.8 | 19.9 | 1.97 | 0.20 | 0.44 | 195 MPa | Good |
| Example 3 | 0.62 | 1.49 | 0.83 | 25.2 | 18.9 | 1.55 | 0.17 | 0.44 | 193 MPa | Good |
| Comparative Example 1 | 0.45 | 1.61 | 0.76 | 25.3 | 19.5 | 1.49 | 0.18 | 0.51 | 169 MPa | Bad |
| Comparative Example 2 | 0.76 | 1.55 | 0.78 | 24.5 | 19.1 | 1.53 | 0.17 | 0.42 | 173 MPa | Good |
| Comparative Example 3 | 0.58 | 1.24 | 0.81 | 24.7 | 18.8 | 1.38 | 0.18 | 0.45 | 193 MPa | Bad |
| Comparative Example 4 | 0.55 | 1.75 | 0.79 | 25.1 | 18.9 | 1.46 | 0.16 | 0.48 | 171 MPa | Good |

TABLE 2-continued

| Classification | C | Si | Mn | Ni | Cr | Nb | N | X/Y | High-temperature tensile strength (900° C.) | Castability |
|---|---|---|---|---|---|---|---|---|---|---|
| Comparative Example 5 | 0.52 | 1.57 | 0.56 | 25.3 | 19.3 | 1.48 | 0.18 | 0.48 | 172 MPa | Good |
| Comparative Example 6 | 0.57 | 1.62 | 1.05 | 25.2 | 18.7 | 1.55 | 0.17 | 0.46 | 192 MPa | Bad |
| Comparative Example 7 | 0.58 | 1.61 | 0.68 | 23.6 | 19.2 | 1.63 | 0.19 | 0.48 | 171 MPa | Good |
| Comparative Example 8 | 0.61 | 1.43 | 0.75 | 26.5 | 18.6 | 1.57 | 0.18 | 0.43 | 195 MPa | Good |
| Comparative Example 9 | 0.62 | 1.52 | 0.77 | 24.8 | 17.6 | 1.47 | 0.17 | 0.42 | 178 MPa | Good |
| Comparative Example 10 | 0.60 | 1.44 | 0.82 | 25.2 | 20.4 | 1.54 | 0.16 | 0.48 | 175 MPa | Good |
| Comparative Example 11 | 0.58 | 1.51 | 0.79 | 25.1 | 19.1 | 0.95 | 0.19 | 0.45 | 168 MPa | Good |
| Comparative Example 12 | 0.54 | 1.56 | 0.83 | 24.7 | 19.3 | 2.05 | 0.18 | 0.49 | 179 MPa | Good |
| Comparative Example 13 | 0.53 | 1.60 | 0.76 | 24.6 | 19.0 | 1.58 | 0.13 | 0.50 | 169 MPa | Good |
| Comparative Example 14 | 0.58 | 1.47 | 0.69 | 24.9 | 18.9 | 1.70 | 0.22 | 0.45 | 193 MPa | Bad |
| Comparative Example 15 | 0.34 | 1.03 | 0.81 | 10.5 | 21.2 | 1.45 | — | 1.11 | 135 MPa | Good |
| Comparative Example 16 | 0.41 | 1.83 | 1.05 | 21.2 | 25.3 | — | — | 0.82 | 144 MPa | Good |
| Comparative Example 17 | 0.35 | 2.21 | 0.75 | 37.1 | 18.3 | 1.67 | — | 0.47 | 191 MPa | Good |
| Comparative Example 18 | 0.50 | 1.70 | 0.60 | 24.0 | 20.0 | 2.0 | 0.15 | 0.54 | 151 MPa | Good |

Table 2 illustrates Examples of the present invention and Comparative Examples and illustrates an alloy element content, tensile strength at a high temperature (900° C.), and castability in Examples and Comparative Examples. A unit of the alloy element content is wt %.

Examples 1, 2, and 3 illustrate a lower limit, an upper limit, and a median for respective components of a casting alloy in the present invention and the X/Y value is in a range of 0.44 to 0.47 and represents high tensile strength at a high temperature.

Comparative Examples 15, 16, and 17 illustrate evaluation results of casting alloys including the Ni content of about 10 wt %, the Ni content of about 20 wt %, and the Ni content of about 35 wt % which are commonly used in the related art, respectively. It can be verified that the high-temperature tensile strength in Comparative Examples 15 and 16 is significantly deteriorated as compared with the Examples. Furthermore, in the case of Comparative Example 17 in which the Ni addition amount is highest at about 35 wt %, castability is good and the high-temperature tensile strength is significantly high at a level of 190 MPa. However, the Ni addition amount is increased and thus there is a limitation in cost reduction. Meanwhile, in the case of Examples 1, 2, and 3, as compared with Comparative Example 17, it can be seen that the Ni addition amount is significantly small and the high-temperature tensile strength has a higher effect.

Comparative Examples 1 to 14 illustrate cases of deviating from the scope of the present invention for each additional component of an invention material and illustrate the case where castability is not good or tensile strength at a high temperature is low.

More particularly, like Comparative Examples 1, 2, 4, 5, 7, and 9 to 13, in the case of deviating from the alloy component range, the tensile strength at a high temperature is low. Meanwhile, in the case of Comparative Examples 3, 6, 8 and 14, the tensile strength at a high temperature is similar to that in Examples 1, 2, and 3, but in the case of Comparative Examples 3, 6 and 14, castability is deteriorated, and in the case of Comparative Example 8, castability is good, but the Ni addition amount is increased and thus the cost competitiveness may be decreased.

Through the Examples and the Comparative Examples, in the alloy component range and the equivalent ratio (X/Y) in the present invention, carbon (C) may be 0.5 to 0.7 wt %, silicon (Si) may be 1.3 to 1.7 wt %, manganese (Mn) may be 0.6 to 1.0 wt %, chrome (Cr) may be 18 to 20 wt %, niobium (Nb) may be 1.0 to 2.0 wt %, nitrogen (N) may be 0.15 to 0.20 wt %, nickel (Ni) may be 24 to 26 wt %, and X/Y may be 0.44 to 0.47.

Therefore, according to the high heat resistant steel with low Ni of the present invention, it is possible to ensure high tensile strength at a high temperature, have high heat resistance, and provide a cost reduction effect by reducing the Ni content.

It is also possible to enable to be reduced in weight and ensure high heat resistance that can withstand a high exhaust gas temperature according to a high-performance and high-output turbocharger, when high heat resistant steel with low Ni of the present invention is applied to a turbine housing.

The invention has been described in detail with reference to preferred exemplary embodiments thereof. However, it will be appreciated by those skilled in the art that changes may be made in these exemplary embodiments without departing from the principles and spirit of the invention, the scope of which is defined in the appended claims and their equivalents.

What is claimed is:

1. A high heat resistant steel having enhanced castability consisting of:

C from about 0.5 to 0.7 wt %,

Si from about 1.3 to 1.7 wt %,

Mn from about 0.6 to 1.0 wt %,

Ni from about 24.0 to 26.0 wt %,

Cr from about 18.0 to 20.0 wt %,

Nb from about 1.0 to 2.0 wt %,

N from about 0.15 to 0.20 wt %, and the remainder of iron (Fe), and inevitable impurities, based on a total weight of the high heat resistant steel, wherein a value of X/Y is 0.44 to 0.47;

the X is a value calculated by Equation 1;

$$X=Cr\ (wt\ \%)+1.5\times Si\ (wt\ \%)+0.5\times Nb\ (wt\ \%) \quad \text{[Equation 1]}$$

the Y is a value calculated by Equation 2;

$$Y=Ni\ (wt\ \%+0.5\times Mn\ (wt\ \%)+30\times C\ (wt\ \%)+30\times N\ (wt\ \%), \quad \text{[Equation 2]}$$

wherein the steel has 190 MPa or more of tensile strength at 900° C.

2. An automotive turbine housing manufactured using the high heat resistant steel of claim 1.

* * * * *